US008683716B2

(12) United States Patent
Raysse et al.

(10) Patent No.: US 8,683,716 B2
(45) Date of Patent: Apr. 1, 2014

(54) SHOE TONGUE SECURING DEVICE

(75) Inventors: David Raysse, Los Angeles, CA (US); Kurt Stockbridge, Palos Verdes Estates, CA (US); Ming Jen Wang, Alhambra, CA (US); Jerome Huang, Dongguan (CN)

(73) Assignee: Skechers U.S.A., Inc. II, Mahattan Beach, CA (US)

( * ) Notice: Subject to any disclaimer, the term of this patent is extended or adjusted under 35 U.S.C. 154(b) by 233 days.

(21) Appl. No.: 13/019,232

(22) Filed: Feb. 1, 2011

(65) Prior Publication Data

US 2012/0192453 A1 Aug. 2, 2012

(51) Int. Cl.

| | |
|---|---|
| ***A43B 23/26*** | (2006.01) |
| ***A43B 11/00*** | (2006.01) |
| ***A43B 23/00*** | (2006.01) |
| ***A43C 11/00*** | (2006.01) |

(52) U.S. Cl.
USPC ..... 36/54; 36/51; 36/45; 36/50.1; 36/52; 36/53

(58) Field of Classification Search
CPC ..... A43B 23/26; A43B 23/25
USPC ..... 36/54, 45, 50.1, 51, 53
See application file for complete search history.

(56) References Cited

U.S. PATENT DOCUMENTS

| | | | | | |
|---|---|---|---|---|---|
| 312,675 | A | * | 2/1885 | Turner | 36/51 |
| 793,095 | A | * | 6/1905 | Rapp | 36/54 |
| 1,247,435 | A | * | 11/1917 | McHannan | 36/51 |
| 3,037,303 | A | * | 6/1962 | Steuer | 36/51 |
| 4,126,951 | A | | 11/1978 | Antonious | |
| 4,377,913 | A | * | 3/1983 | Stone | 36/99 |
| 4,442,613 | A | | 4/1984 | Dobbin | |
| 4,584,783 | A | | 4/1986 | Dobbin | |
| 4,628,622 | A | * | 12/1986 | McBarron | 36/50.1 |
| 4,805,321 | A | | 2/1989 | Tonkel | |
| 4,845,864 | A | * | 7/1989 | Corliss | 36/131 |
| 5,027,482 | A | * | 7/1991 | Torppey | 36/50.1 |
| 5,230,171 | A | * | 7/1993 | Cardaropoli | 36/50.1 |
| D352,784 | S | * | 11/1994 | Cohen et al. | D24/192 |
| 5,826,353 | A | * | 10/1998 | Woznicki | 36/54 |
| 5,893,222 | A | * | 4/1999 | Donnelly | 36/117.6 |
| 5,907,912 | A | * | 6/1999 | Alaimo | 36/50.1 |
| 6,094,841 | A | * | 8/2000 | Adams | 36/99 |
| 6,230,423 | B1 | * | 5/2001 | Donnelly | 36/117.6 |
| 6,408,542 | B1 | | 6/2002 | Shepherd | |
| 6,895,696 | B1 | | 5/2005 | Sanders | |
| 6,904,706 | B2 | | 6/2005 | Jones et al. | |
| 6,971,192 | B2 | | 12/2005 | Shepherd | |
| 7,392,603 | B1 | | 7/2008 | Shepherd et al. | |
| 7,487,603 | B2 | * | 2/2009 | Davis et al. | 36/50.1 |
| 7,685,739 | B2 | | 3/2010 | Aveni et al. | |
| 7,765,721 | B2 | * | 8/2010 | Hentz et al. | 36/50.1 |
| 7,774,957 | B2 | | 8/2010 | Shepherd | |
| 7,877,901 | B2 | * | 2/2011 | Calderone | 36/50.1 |

(Continued)

*Primary Examiner* — Khoa Huynh
*Assistant Examiner* — Timothy K Trieu
(74) *Attorney, Agent, or Firm* — Marshall A. Lemer; Marvin H. Kleinberg; Kleinberg & Lerner, LLP

(57) ABSTRACT

A shoe having an upper with a tongue and an outer shell in which the tongue has a bulging extension on the medial side, in which the outer surface of the tongue has a connector that is aligned with a connector on the inner surface of the outer shell. When the connectors are aligned together, the tongue is secured to the outer shell.

7 Claims, 4 Drawing Sheets

(56) References Cited

U.S. PATENT DOCUMENTS

| | | | |
|---|---|---|---|
| 2002/0144435 | A1 | 10/2002 | Shepherd |
| 2005/0223598 | A1 | 10/2005 | Jones et al. |
| 2007/0261266 | A1 | 11/2007 | Jones et al. |
| 2007/0289168 | A1 | 12/2007 | Jones et al. |
| 2010/0107447 | A1 | 5/2010 | Jones et al. |

* cited by examiner

SHOE TONGUE SECURING DEVICE

BACKGROUND OF THE INVENTION

1. Field of the Invention

The present invention relates to footwear and, in particular, to a shoe with a secured tongue. The benefits are imparted from a more comfortable and aesthetically pleasing shoe with a tongue that does not move during motion and thus does not chafe and add discomfort to the wearer.

Shoes comprise an upper, midsole and outsole. Typically, the upper on an athletic shoe comprises of an outer shell and tongue. The tongue allows the user to easily insert the user's foot into the shoe and also provides support to the upper. Furthermore, the tongue diffuses the pressure from the laces which are found on top of the tongue. However, during strenuous activity such as running, the tongue tends to shift locations and move, specifically towards the lateral side of the shoe, thus causing chafing and discomfort to the user. Since the tongue shifts locations, it can no longer properly diffuse pressure along the foot and therefore, additional discomfort from the pressure from the laces becomes apparent. There is a need for a device that secures the tongue to the outer shell, yet still maintains comfort and adjustability.

2. Description of Related Art

Prior art shoes with no means of securing the tongue tend to have tongues that continuously shift and move during activities such as running. This causes chafing, discomfort and the design and aesthetic qualities of the shoe to be compromised.

Prior art shoes have attempted to secure the tongue by placing Velcro®/hook and loop connectors to the top of the tongue or around the eyelets. However, this does not allow for much adjustability of the tongue and may present discomfort to the user.

Other prior art shoes have attempted to secure the tongue by placing elastic strips connected to the tongue and to a portion of the midsole or the bottom of the outer shell. However, this has led to constrained and uncomfortable feet due to the elastic material being too tight.

The present invention aims to provide a shoe with a tongue secured to the outer shell while not inducing any pain, maintaining comfort and providing visual appeal by maintaining the integrity of the design of the upper with the tongue in place.

BRIEF SUMMARY OF THE INVENTION

It is an object of the present invention to provide a shoe with a tongue secured to the outer shell without inducing any pain, discomfort and to maintain the visual appeal and integrity of the design. To achieve this, the present invention comprises a shoe having an upper (which is comprised of an outer shell and a tongue), an outsole, and a midsole, each having a medial side and a lateral side. In a preferred embodiment, the tongue has a bulging flap that extends outwardly towards the middle of the medial side. The bulging flap contains a hook connector placed above the tongue, facing the outer shell. The outer shell has a corresponding loop connector placed below the outer shell facing the tongue. When the shoe is being worn by a user, the hook and loop connector keeps the tongue in place and prevents any chafing and discomfort. Furthermore, when the user is putting on the shoe, the user can easily remove the tongue and alter its location for the proper fit.

The shoe comprises an upper, an outsole, and a midsole, each having a medial side and a lateral side. The upper comprises of an outer shell and a tongue. The medial side is the portion closest to the opposite leg and the lateral side is opposite the user's other leg.

The upper, midsole and outsole each has a frontmost point and a rearmost point substantially opposite the frontmost point. As the terms imply, each frontmost point is closer to the user's toes than each rearmost point and correspondingly each rearmost point is closer to the user's heel than each frontmost point.

The outer shell has an outer surface and an inner surface. The outer surface is the surface that faces away from the user's foot and the inner surface is the surface that faces towards the user's foot.

The tongue has an outer surface and an inner surface. The outer surface is the surface that faces away from the user's foot and the inner surface is the surface that faces inwardly towards the user's foot.

The tongue is permanently connected to the outer shell on the bottom portion of the frontmost point of the tongue. The edges of the outer shell overlap the tongue.

The tongue has a medial and lateral side. Edges, which are part of the medial and lateral side are below and overlap the outer shell. The outer surface of the tongue on those edges of the tongue faces the inner surface of the outer shell.

The medial side of the tongue has a bulging flap that extends outwardly. The bulging flap contains a connector that is placed on the outer surface of the tongue so that the connector faces the inner surface of the outer shell. In the preferred embodiment, the connector is a hook and loop connector, or Velcro® connector. The tongue specifically contains the hook connector of the hook and loop connector so that it cannot snag or damage the user's sock or foot.

The medial side of the inner surface of the outer shell has a connector that corresponds to the connector that is placed on the outer surface of the tongue. The outer shell specifically contains the loop connector of the hook and loop connector. The loop connector of the outer shell is larger than the hook connector on the tongue. As a result, it allows the user to customize the fit of the tongue.

When the connector on the tongue is juxtaposed against the connector on the outer shell, the tongue is secured. Therefore, the tongue will not move during use and thus it will not cause chafing and it will allow the shoe to retain its design and look.

BRIEF DESCRIPTION OF THE SEVERAL VIEWS OF THE DRAWINGS

By way of example only, selected embodiments and aspects of the present invention are described below. Each such description refers to a particular figure ("FIG.") which shows the described matter. All such figures are shown in drawings that accompany this specification. Each such figure includes one or more reference numbers that identify one or more part(s) or element(s) of the invention.

DETAILED DESCRIPTION OF THE INVENTION

Figure 1:
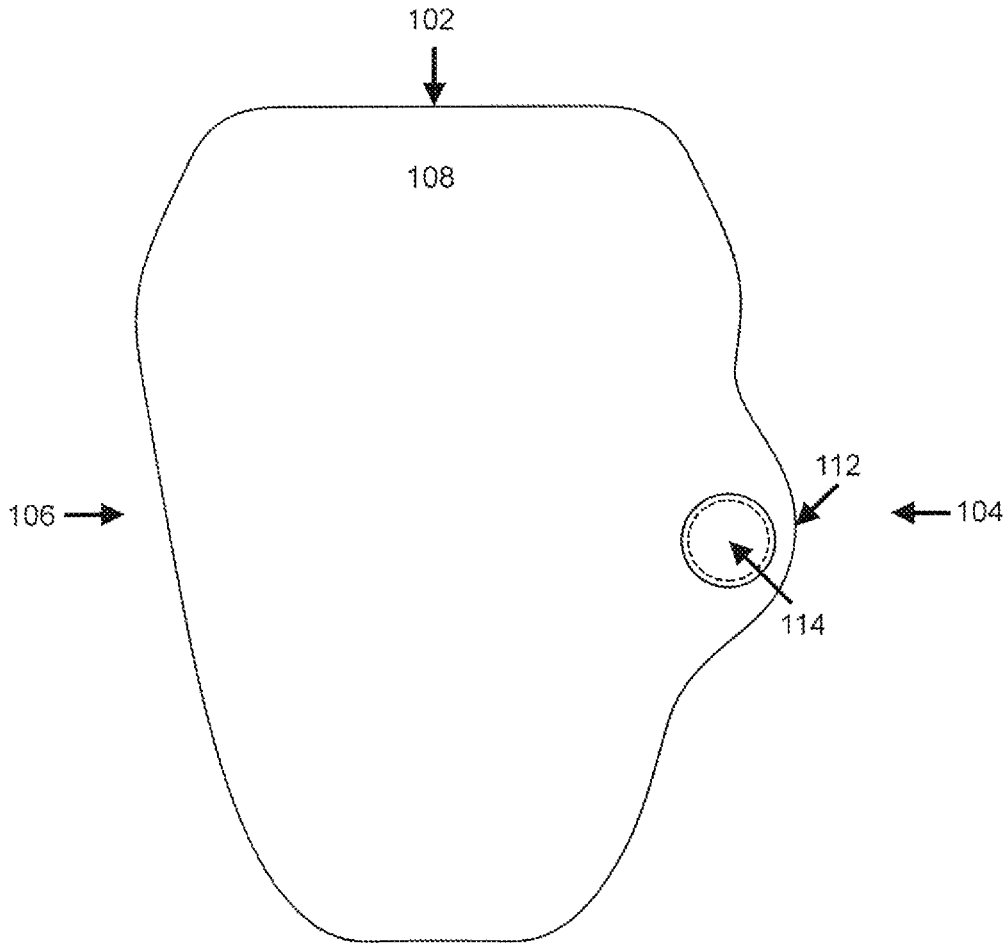
FIG. 1 is a plan view of an embodiment of the tongue.

The invention will now be described with reference to the preferred embodiment of the tongue shown in FIG. 1. This embodiment shows a tongue 102 separated from the shoe 100, shown in FIGS. 3 and 4. The shoe 100 to has medial side 104 and a lateral side 106. The tongue 102 has an outer surface 108 and an inner surface 110 shown in FIG. 2.

The tongue 102 has a bulging flap 112 that extends outwardly on the medial side 104. The bulging flap 112 has a connector 114 on the outer surface 108 of the tongue. The connector 114 is typically a hook and loop connector. If a hook and loop connector is used, the connector 114 is the hook portion.

Figure 2:
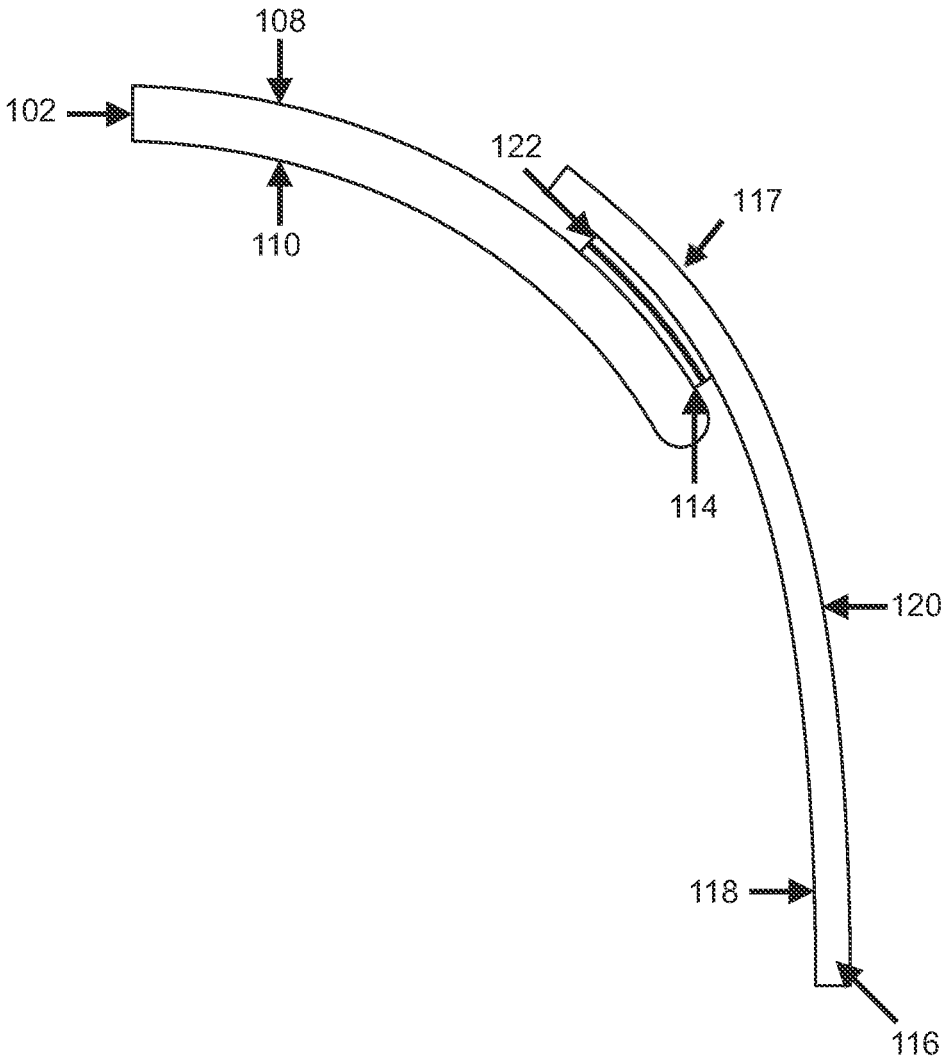
FIG. 2 is an elevation view in cross section of the medial side of the shoe showing the embodiment of the tongue and outer shell.

An elevation view of a cross section of the medial side 104 of the tongue 102 and outer shell 116 is shown in FIG. 2. The outer shell 116 has an inner surface 118 and an outer surface 120. The outer shell 116 has a medial quarter 117. The inner surface 118 of the outer shell 116 has a connector 122. The connector 122 aligns with connector 114. The connector 122 is typically a hook and loop connector. If a hook and loop connector is used, the connector 122 is the loop portion. The connector 122 may have a slightly larger surface than connector 114 to allow customization of the placement of the hook and loop connector.

Figure 3:
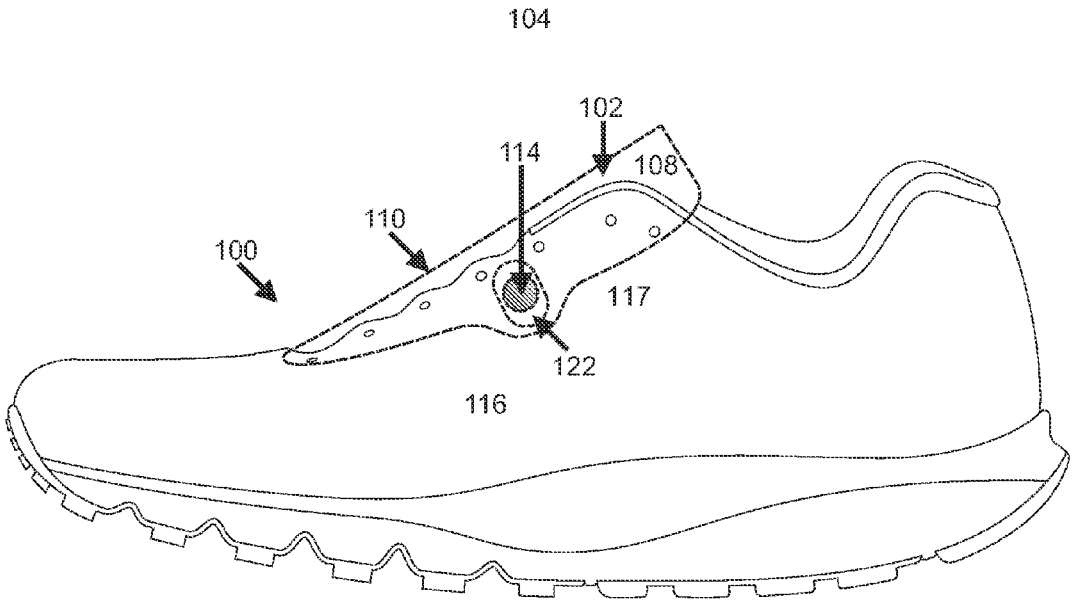
FIG. 3 is an elevation view of an embodiment of a shoe with the tongue shown in dotted lines through the outer shell.
Figure 4:
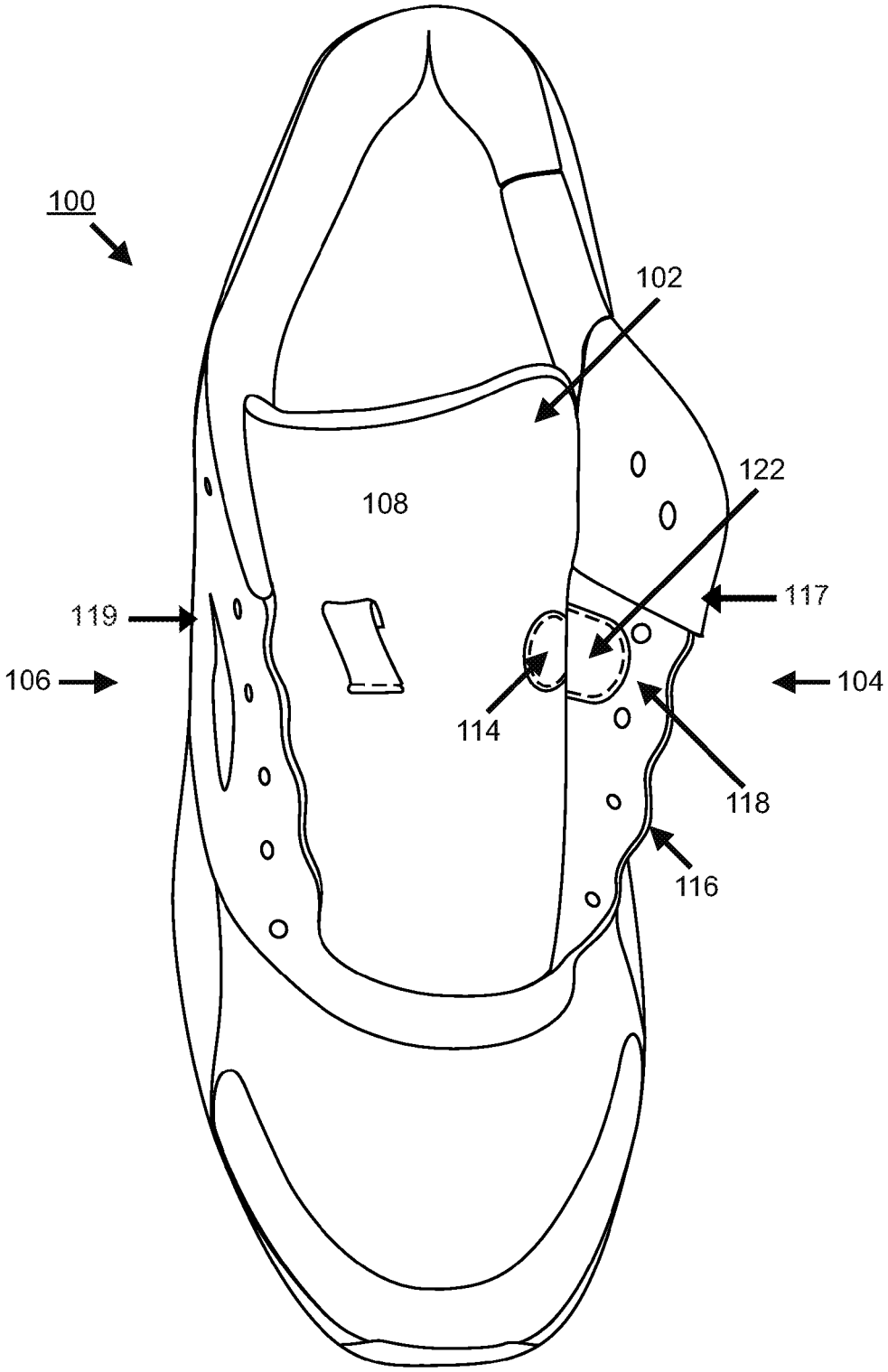
FIG. 4 is a top plan view of an embodiment of a shoe.

FIG. 3 shows an elevation view of the medial side 104 of the shoe 100 with the tongue 102 showing through the outer shell 116. As shown in FIG. 4 the tongue 102 is beneath the outer shell's 116 medial quarter 117, so that the outer surface 108 of the tongue 102 faces the inner surface 118 of the outer shell 116. The connector 114 affixed to the outer surface 108 of the tongue 102 is positioned to connect to the connector 122 of the inner surface 118 of the outer shell 116. The connector 114 connects to connector 122 to secure the tongue 102 to the outer shell 116.

A top plan view of an embodiment of the shoe 100 is shown in FIG. 4. It shows the placement of the tongue 102 to be permanently connected at 124 to the outer shell 116 only on the bottom portion of the frontmost point of the tongue 102 and the tongue 102 to be below the outer shell's 116 medial quarter 117 and lateral quarter 119. It shows the connector 114 on the outer surface 108 of the tongue 102 lining up to the connector 122 on the inner surface 118 of the outer shell 116. Thus, when the connector 114 and connector 122 are positioned in surface contact, the tongue 102 is secured to the outer shell 116 to prevent the tongue from moving during the user's footsteps. This stabilization of the position of the tongue prevents chafing and discomfort to the wearer.

While the foregoing detailed description sets forth selected embodiments of a shoe tongue securing device in accordance with the present invention, the above description is illustrative only and not limiting of the disclosed invention. The claims that follow herein collectively cover the foregoing embodiments. The following claims further encompass additional embodiments that are within the scope and spirit of the present invention.

What is claimed is:

1. A shoe having an upper, a midsole, and an outsole, wherein said upper comprises:

an outer shell having a medial quarter and a lateral quarter, a tongue having a medial side and a lateral side, wherein said outer shell has an outer surface and an inner surface, wherein said outer shell has at least one eyestay, wherein said tongue has an outer surface and an inner surface, wherein said tongue is permanently connected to the outer shell only on the bottom portion of the frontmost point of the tongue, wherein said outer shell's medial quarter has an area of overlap with said tongue's medial side such that the inner surface of the outer shell's medial quarter faces the outer surface of the tongue's medial side, wherein said outer shell's lateral quarter has an area of overlap with the tongue's lateral side such that the inner surface of the outer shell's lateral quarter faces the outer surface of the tongue's lateral side, wherein said areas of overlap place the tongue underneath the at least one eyestay, wherein said tongue has a bulging flap on the outer surface of the tongue, wherein said bulging flap bulges outwardly away from the side of the tongue, and wherein said bulging flap has a connector disposed on the outer surface of the tongue, and wherein said outer shell has a connector on the inner surface positioned in a location beneath the ankle and said connector on the bulging flap is aligned with said connector on the outer shell.

2. The shoe of claim 1 wherein said bulging flap is located approximately midway along the side of said tongue.

3. The shoe of claim 2 wherein the bulging flap is on the medial side.

4. The shoe of claim 1 wherein the connector on said tongue and the connector on said outer shell are hook and loop connectors.

5. The shoe of claim 1 wherein the connector on said tongue and the connector on said outer shell are on the medial side.

6. A shoe having an upper, a midsole, and an outsole, wherein said upper comprises:

an outer shell having a medial quarter and a lateral quarter, a tongue having a medial side and a lateral side, wherein said outer shell has an outer surface and an inner surface, wherein said outer shell has at least one eyestay, wherein said tongue has an outer surface and an inner surface, wherein said tongue is permanently connected to the outer shell only on the bottom portion of the frontmost point of the tongue, wherein said outer shell's medial quarter has an area of overlap with said tongue's medial side such that the inner surface of the outer shell's medial quarter faces the outer surface of the tongue's medial side, wherein said outer shell's lateral quarter has an area of overlap with the tongue's lateral side such that the inner surface of the outer shell's lateral quarter faces the outer surface of the tongue's lateral side, wherein said areas of overlap place the tongue underneath the at least one eyestay and wherein said tongue has a bulging flap on the medial side, said bulging flap has a hook connector disposed on the outer surface of the tongue, wherein said connector is positioned in a location beneath the ankle, and wherein said outer shell has a loop connector on the inner surface, and said hook connector on said bulging flap is aligned with said loop connector on the outer shell, said bulging flap being located approximately midway along the sides of said tongue and bulges outwardly away from the sides of said tongue.

7. A shoe having an upper, a midsole, and an outsole, wherein said upper comprises:

an outer shell having a medial quarter and a lateral quarter, a tongue having a medial side and a lateral side, wherein said outer shell has an outer surface and an inner surface, wherein said outer shell has at least one eyestay, wherein said tongue has an outer surface and an inner surface, wherein said tongue is permanently connected to the outer shell only on the bottom portion of the frontmost point of the tongue, wherein said outer shell's medial quarter has an area of overlap with said tongue's medial side such that the inner surface of the outer shell's medial quarter faces the outer surface of the tongue's medial side, wherein said outer shell's lateral quarter has an area of overlap with the tongue's lateral side such that the inner surface of the outer shell's lateral quarter faces the outer surface of the tongue's lateral side, wherein said areas of overlap place the tongue underneath the at least one eyestay, and wherein said tongue has a bulging flap on the medial side, said bulging flap has a loop connector disposed on the outer surface of the tongue, wherein said connector is positioned in a location beneath the ankle, and wherein said outer shell has a hook connector on the inner surface, and said loop connector on said bulging flap is aligned with said hook connector on the outer shell, said bulging flap being located approximately midway along the side of said tongue and bulges outwardly away from the side of said tongue.

* * * * *